United States Patent [19]

Blume, deceased et al.

[11] 4,035,914

[45] July 19, 1977

[54] SHEAR FOIL FOR A DRY SHAVER

[75] Inventors: Friedrich Blume, deceased, late of Schwalbach, Taunus, Germany, by Edith Inge Blume, heir; Monika Ingrid Blume, heir, Schwalbach, Taunus, Germany; Friedrich Blume, heir, Schwalbach, Taunus, Germany; Werner Messinger, Kronberg, Taunus, Germany; Josef Schiffer, Oberroden, Germany

[73] Assignee: Braun Aktiengesellschaft, Frankfurt am Main, Germany

[21] Appl. No.: 634,406

[22] Filed: Nov. 24, 1975

[30] Foreign Application Priority Data

Nov. 25, 1974 Germany ..... 2455723

[51] Int. Cl.[2] ..... B26B 19/04

[52] U.S. Cl. ..... 30/346.51; 76/104 R

[58] Field of Search ..... 30/43.7–43.92, 30/346.51; 76/104 R

[56] References Cited

U.S. PATENT DOCUMENTS

| | | | |
|---|---|---|---|
| 3,068,568 | 12/1962 | Schnapp | 30/346.51 |

FOREIGN PATENT DOCUMENTS

| | | | |
|---|---|---|---|
| 816,366 | 7/1969 | Canada | 30/346.51 |
| 1,212,444 | 10/1966 | Germany | 30/346.51 |
| 2,305,680 | 8/1973 | Germany | 30/346.51 |
| 2,023,305 | 12/1971 | Germany | 30/346.51 |

*Primary Examiner*—Gary L. Smith
*Attorney, Agent, or Firm*—Michael J. Striker

[57] ABSTRACT

A shear foil for a dry shaver has a flexible sheet material body a central portion of which is provided with holes of a diameter between substantially 0.3 and 0.7 millimeters for the passage of beard stubble, and peripheral portions of which serve as mounting portions and are provided with holes of a diameter smaller than those in the central portion but not less than substantially 0.02 millimeters. The holes in the respective portions are separated by sheet material strips whose dimensions are so selected that the bending resistance of the shear foil body is substantially uniform throughout and that the portions of the body can withstand the maximum expected tensile and pressure forces.

11 Claims, 9 Drawing Figures

SHEAR FOIL FOR A DRY SHAVER

BACKGROUND OF THE INVENTION

The present invention relates to a shear foil for dry shavers, and more particularly to a shear foil which is provided with holes throughout.

Dry shavers having vibrating cutting systems are provided with shear foils which are bent substantially in a semi-cylindrical configuration over the cutting edge of the cutting system which is reciprocated in a straight-line movement beneath the shear foil so that the cutting edges of the system cut off the beard hair that projects through holes in the shear foil when the latter is placed against the face of a user. In some instances the cutting system is rotated, rather than reciprocated in a straight line.

One of the factors which influences the quality of the shave that can be obtained with a dry shaver of this kind, is the perforation of the shear foil itself. Many different types of perforations have been tried in an attempt to arrive at an optimum type of perforation which will give close and comfortable shaves. It is known to provide shear foils with circular holes, with quadratic holes, with honeycomb-shaped holes, with rectangular and with eliptical holes. One thing that all shear foils of the prior art have in common despite the differences in the holes is that the shear foil should have the least possible thickness so that the cutting edges of the cutting system should be located as close as possible to the face of the user and therefore cut off the beard hair as short as possible. It has also been found desirable in this connection to provide in the shear foil, particularly in the region of the central portion thereof, the ratio of the total cross-sectional area of the holes to the ratio of the remaining unperforated part of the shear foil body, as large as possible. On the other hand, the ratio of holes to unperforated perforated portion of the shear foil body cannot be made to exceed a certain limit, because otherwise the skin of the user might in part be pressed through the holes and come in contact with the cutting edges of the cutting system which would lead to possible injury and certainly to discomfort.

However, it is not only the size and geometric configuration of the holes in the shear foil which are important in terms of obtaining a good and close shave. Another factor to be considered in the configuration of the holes in direction normal to the surface of the shear foil. To have a comfortable shave which is not painful to the skin, the holes in the shear foil must be rounded at the side of the shear foil which contacts the skin of a user. This assures that the beard hairs will readily enter the holes when the shear foil is made to move over the surface of the skin of the user, and that the feel of the shear foil on the skin is smooth and soft.

Special requirements are also made of the holes at the side of the shear foil which faces the cutting edges of the cutting system. For exmple, if the shear foil were to be completely planar, then the punching of holes in direction strictly normal to the shear foil would, when the shear foil is in contact with the cutting edges of the cutting system, cause the cutting edges to be in contact with the unperforated portions of the shear foil intermediate the holes. This results in a relatively high amount of frictional heating which is found uncomfortable on the skin of a user. For this reason it has been attempted to make the unperforated portions of the shear foil intermediate the holes —which are formed in rows— curved so that the contact between these unperforated portions and the cutting edges is as small as possible, thus reducing the frictional heading Generally speaking, it is now industry practice to so configurate the contact face that it does not exceed a third of the total surface of the foil.

When such shear foils are produced, where the shear foil portions bounding the holes on the inwardly directed side of the shear foil are raised with respect to the surrounding non-perforated part of the shear foil, it must be assured that the raised part is not high enough to prevent the beard hair from being cut as close as possible to the skin. On the other hand, if the raised part is made relatively low, this often results in a weak marginal portion of the shear foil because the central part of the shear foil and the marginal portion are produced in a unitary operation. For example, if the shear foil is produced by drilling, stamping or the like, and if the starting material is a non-perforated steel foil whose strength would be sufficient to withstand the maximum expected textile and pressure forces to which it would later be subjected as a shear foil, then the raised portions bounding the openings would be too high and the beard hair would not be cut close enough to the skin. On the other hand, if the steel foil used as a starting material is thin enough to assure that the beard hair is cut off close to the skin, then the marginal portion of the shear foil is generally too weak to be able to withstand the forces that act upon the shear foil in use. To overcome this problem it is customary to reinforce the marginal portions by separate reinforcing elements.

In the case of the drilled, stamped or otherwise produced steel foils which are converted into shear foils, there is the disadvantage that relatively complicated hole configurations are difficult to produce. As a general rule, foils of this type are usually provided with holes of cylindrical configuration whose edges are more or less sharp. This means that if the user happens to have a tender skin, there will be substantial friction upon it by the small sharp edges and great discomfort will be caused. Moreover, steel tends to readily corrode in moisture, for example near the sea shore or in the tropics.

Present-day shear foils are usually produced galvanoplastically or by means of etching. A particularly advantageous shear foil material has been found to be nickel. However, in the case of shear foils which are produced galvanoplastically analogous problems as in the case of steel foils are found. Here, again, a compromise must be made between the thickness in the central region of the foil and the thickness at the foil margin. In addition, when a shear foil is produced galvanoplastically, there is the further fact that due to distortions of the electric field used in producing the shear foil the deposition of material is different at the perforated parts of the foil than at the non-perforated parts. This means that marginal portions of shear foils which are produced galvanoplastically require as a rule reinforcing element to make them strong enough so as to prevent the shear foil from becoming destroyed.

It had also been proposed, in order to prevent destruction of the shear foil at the transitional zone which connects the central perforated portion to the marginal portions, and in which particularly high stresses develop, to decrease the holes in the outer portions of the apertured part while leaving identical center-to-center spacing. However, experience has shown that if resort is had to this proposal, the marginal portions are still not strong enough to withstand the stresses that act upon them and must still be provided with reinforcing elements.

A further proposal suggests that the central portion have the holes distributed according to a constant grid, whereas the size of the holes in the marginal portion decreases towards the edge in direction transverse to the direction of movement of the cutting system. The ratio of the hole size to the foil thickness is substantially constant in the marginal zone. However, it has been found that this also is not a construction in which separate reinforcing elements can be omitted.

Further constructions have proposed holes having different sizes, i.e. the size of the holes in direction transverse to the movement of the cutting system varies. The purpose of these constructions is to accommodate them to beard hairs of different thickness. However, these foils also cannot do without separate reinforcements for the marginal mounting portions.

SUMMARY OF THE INVENTION

Accordingly, it is a general object of the present invention to provide an improved shear foil for a dry shaver which is not possessed of the aforementioned disadvantages.

More particularly, it is an object of the invention to provide such a shear foil which is so constructed that it is strong and stable in its marginal portions, that it has a substantially uniform flexibility everywhere, and that its central portion is so thin that it assures a close shave.

In keeping with these objects, and with others which will become apparent hereafter, one feature of the invention resides in a shear foil for a dry shaver which, briefly stated, comprises a flexible sheet material body having a central portion provided with holes of a diameter between substantially 0.3 and 0.7 millimeters for passage of beard stubble therethrough, and peripheral shear-foil mounting portions provided with holes of a diameter smaller than those in the central portion but not less than substantially 0.02 millimeters. The holes in the respective portions are separated by sheet material strips having dimensions so selected that the bending resistance of the body is substantially uniform throughout and that the portions of the body can withstand the maximum expected tensile and pressure forces.

A bending resistance which is substantially uniform throughout the entire shear foil is obtained according to the present invention if the ratio of the width of the non-perforated strips between the rows of holes and the diameters of the holes in the peripheral portions is approximately 3 : 1. Other dimensions can be calculated by those having ordinary skill in the art.

A shear foil constructed in this manner requires no additional reinforcing or mounting elements and can be produced in a very simple manner galvanoplastically.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
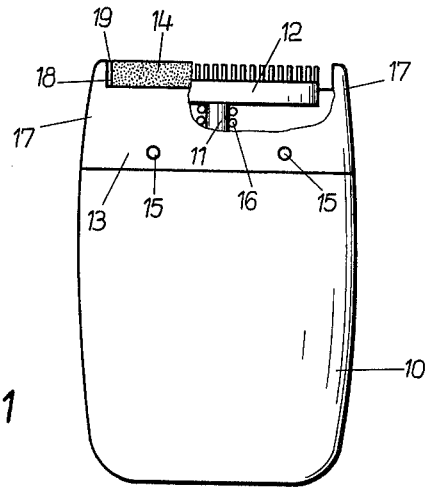
FIG. 1 is a partially sectioned side-elevational view of a dry shaver employing a shear foil of the invention.

Referring first to FIG. 1, it will be seen that reference numeral 10 identifies a diagrammatically shown dry shaver in which a motor (not shown) is accommodated in known manner. The motor drives an arm 11 which transmits movement to a cutting system 12 so that the latter performs translatory oscillating movements. The housing 10 is provided with a removable shear head frame 13 which carries a flexible shear foil 14 that is mounted in semi-cylindrical configuration on bolts 15. A helical spring 16 which surrounds the arm 11 presses the cutting system 12 from below against the underside of the shear foil 14. The frame 13 is so dimensioned that a gap 19 remains between its two ends 17 and the adjacent curved end edges 18 of the foil 14, so that when the foil 14 is placed against the skin of a user and pressure is exerted, it can readily yield in direction inwardly of the housing 10 counter to the biasing action of the spring 16.

Figure 2:
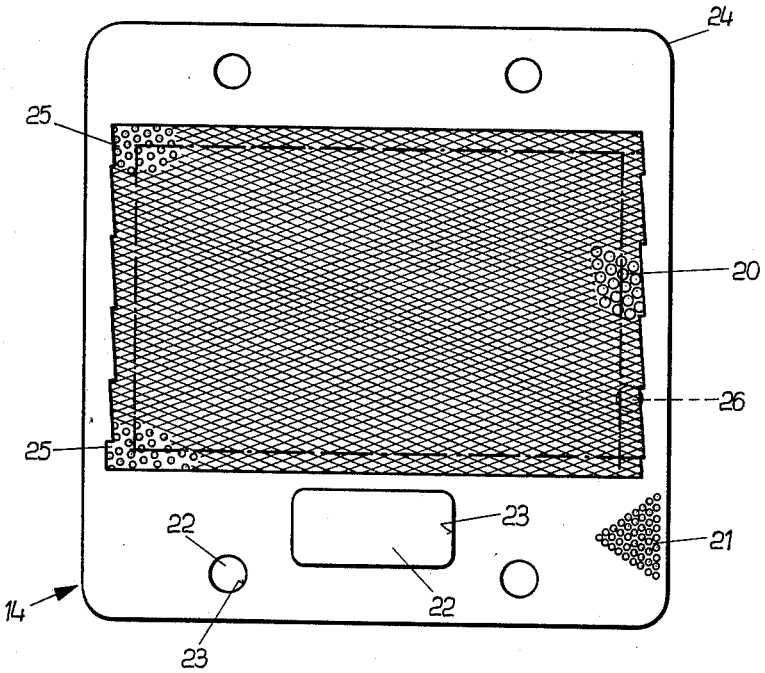
FIG. 2 is a plane view of a shear foil.

FIG. 2 shows the shear foil 14 of FIG. 1 in detail. The shear foil 14 essentially has a central perforated portion 20, a peripheral perforated portion 21, cutouts 22, edges 23 bounding the cutouts 22, a circumferential edge 24 and a transitional region 25.

The central portion 20 may have holes of various different shapes, and in fact different shapes may be mixed together, but they must all fulfill the requirement that the beard stubble hair be capable of passing through them. For this reason the diameter of these holes will be between substantially 0.3 millimeters and 0.7 millimeters. It has been found that the median thickness of a beard hair in a beard of average strength is only 0.07 millimeters, but it is not possible to make the holes so small that they would just be able to accommodate a beard hair, because experiments have shown that the hair will then not enter into the holes. Also, the fact that the holes in the central portion 20 are as large as indicated is to make it possible for more than one beard hair to pass simultaneously through the hole.

The cutouts 22 serve to receive mounting members which are necessary to mount the shear foil on the dry shaver. The large cutout 22 shown in FIG. 2 to be of rectangular outline has a different function, namely it serves to permit a drive element of a long hair cutter to pass through the shear foil. Such long hair cutters are known and will therefore not be described in detail, especially as they do not form part of the invention. All cutouts 22 are bounded by edges 23 that are smooth so as to prevent a tearing inwardly of these edges. These edges may be reinforced, just as the edge 24 which bounds the shear foil 14. The thickness and width of the edges 23, 24 is advantageously the same as the thickness and width of the unperforated portions located between the rows of holes.

The transitional portion 25 is not actually located in the real shaving zone, i.e., it does not in itself actually ordinarily participate in shaving, but its holes are so dimensioned that they do permit the passage of beard hair through them.

Figure 3:
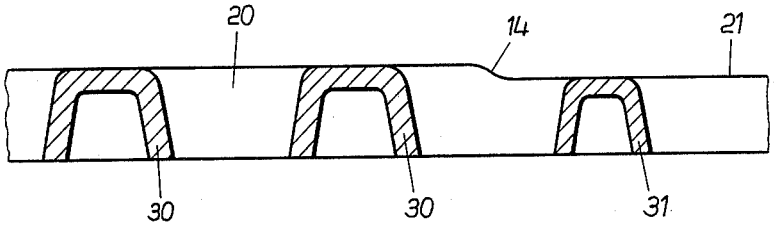
FIG. 3 is a fragmentary cross section through a shear foil of the invention.

FIG. 3 is a transverse section through a portion of the foil 14 in FIG. 2, at the area which is identified with reference numeral 26 in FIG. 2. It will be seen that both in the central portion 20 and in the peripheral portion 21 the holes are provided with raised edges 30 and 31, respectively. The thickness of the foil is greater in the central portion 20 than in the peripheral portion 21. This is not intended, but a circumstance which at times occurs when the foil according to the present invention is manufactured galvanoplastically. However, it is pointed out that the size of the hole in the peripheral portion 21 is intentionally shown to be smaller than the size of the holes in the central portion 20.

Figure 4:
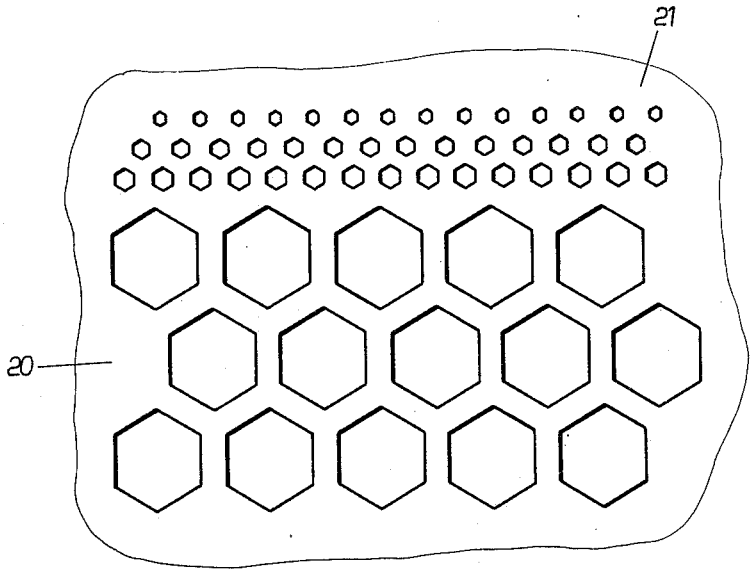
FIG. 4 is a fragmentary enlarged plan view of a shear foil of the invention, showing the region in which the central and a peripheral portion merge with one another.

FIG. 4 shows a fragmentary plan view, on an enlarged scale, of the shear foil 12 in FIG. 2, for example again in the region 26 thereof, but generally any other region at the transition between the central portion 20 and the peripheral portion 21. The holes in the portions 20 and 21 are of polygonal shape, but could have any other geometric outline. It will be noted that the ratio of the hole diameter to unperforated strip width is almost reversed in the two portions 20 and 21. Whereas in portion 21 the unperforated strip width between the rows of holes is approximately three times as wide as the diameter of the holes, the diameter of the holes in the central portion 20 is approximately three times greater than the unperforated strip width between them.

Figure 5:
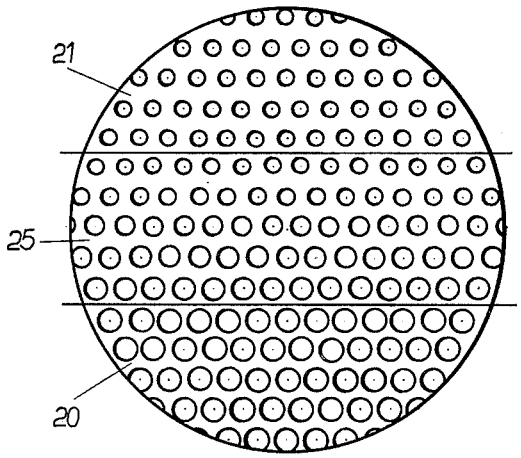
FIG. 5 is a fragmentary enlarged plan view of the region in which the shear foil of the invention is provided with a transitional portion, showing the holes in the transitional portion to decrease in size while remaining at constant spacing.

FIG. 5 shows an enlarged fragmentary detail view of a shear foil 14 which has a transitional region between the portions 20 and 21, the transitional region identified with reference numeral 25. For the sake of simplicity, only circular holes are shown. It will be noted that the circular holes in the portion 20 are all of identical diameter and have center-to-center spacing from one another which are all identical. However, the holes in the transitional region 25 also have identical center-to-center spacing but are of different diameters. It will be noted that in the transitional region 25 the holes with the largest diameters are adjacent the portion 20 whereas in the direction towards the portion 21 the diameter of the holes in the transitional region 25 decreases. The holes having the smallest diameter are located immediately adjacent the portion 21. The holes in the portion 21, on the other hand, are all identical in diameter and are all at identical center-to-center spacing. The holes in the central portion 20 may have a diameter of approximately 0.5 millimeters, for example, whereas the diameter of the holes in the peripheral portion 21 may be approximately 0.05 millimeters.

Figure 6:
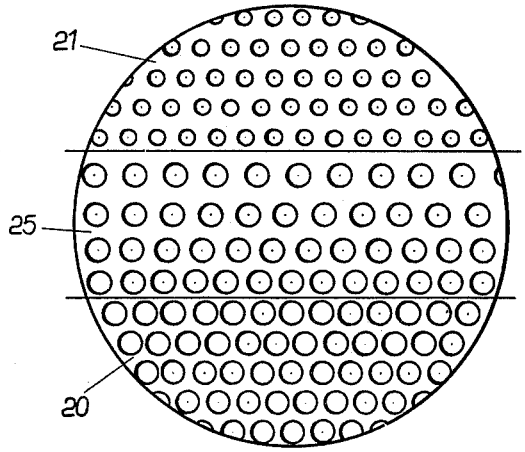
FIG. 6 is a view similar to FIG. 5, but illustrating an embodiment in which the spacing between the holes in the transitional portion increases while the diameter of the holes remains unchanged.

FIG. 6 is reminiscent of FIG. 5 except that in this embodiment the transitional region 25 differs from that in FIG. 5 in that its holes are all of identical diameter, whereas the center-to-center spacing between the holes in the transitional region 25 increases in direction from the portion 20 towards the portion 21. The effect obtained is essentially the same as in FIG. 5, but with different means. In other words: in both cases the stability of the shear foil 14 increases in direction towards the peripheral portion 21.

Figure 7:
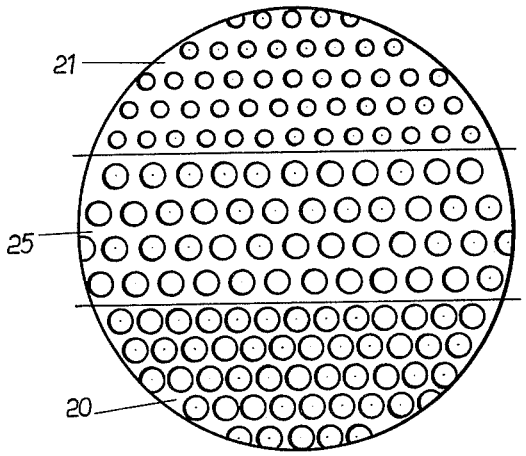
FIG. 7 is a view similar to FIG. 6, illustrating an embodiment in which the holes in the transitional portion are as large as those in the central portion, but have greater spacing between one another.

In the embodiment of FIG. 7 the portions 20 and 21 are configurated as shown in FIG. 5. The difference is in the transitional region 25 where neither the hole diameters nor the center-to-center spacing between the holes varies. The hole diameters are constant, and may for example be equal to the diameters of the holes in the portion 20. However, the center-to-center spacing between the holes in the region 25 is larger than in the portion 20, therefore again increasing the stability and strength of the transitional region 25 as compared to the center portion 20.

Figure 8:
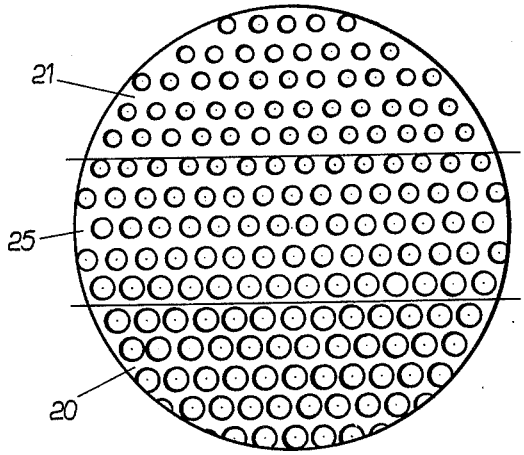
FIG. 8 is a view similar to FIG. 6, but showing that the last row of the transitional portion is extended to the peripheral portion.

The embodiment in FIG. 8 differs from that in FIG. 5 again only in one respect, but in this case it is the peripheral portion 21. In this embodiment of FIG. 8 the holes of the peripheral portion 21 are not significantly smaller than those of the transitional portion 25, as is the case in FIG. 5; instead, in FIG. 8 the diameter of the holes in the portion 21 corresponds to the diameter of the last row of holes in the transitional region 25, so that it may in effect be said that the last of the holes in the transitional region 25 where the same merges into the portion 21, is continued throughout the portion 21.

Figure 9:
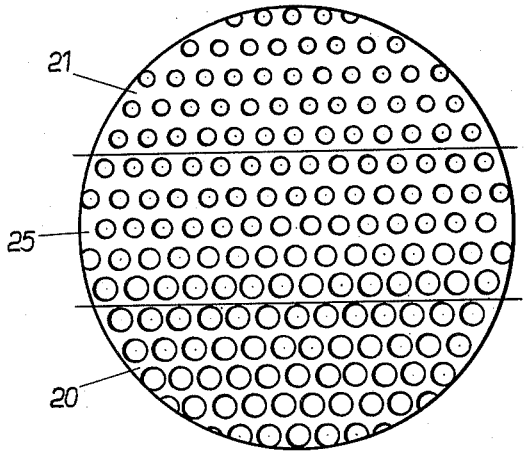
FIG. 9 is a view similar to FIG. 5, but showing the holes in the transitional portion merging continuously into the peripheral portion.

FIG. 9 shows another embodiment which is again the same as FIG. 5 insofar as the portion 20 and the region 25 is concerned. In the portion 21, however, the holes are not of identical diameter, but instead their diameter decreases in direction towards the edge of the shear foil, i.e. away from the portion 20 and the region 25. Here the transitional region 25 and the portion 21 in effect merge into one another.

Of course, it will be understood that further variations are possible, by varying and appropriately combining the two parameters, hole diameter and center-to-center spacing.

The shear foils according to the present invention, as described herebefore, can be produced with all known methods of shear foil manufacture. The galvanoplastic manufacture is currently preferred and may for example be carried out in the manner disclosed in German Patent No. 1,195,134 where a light-sensitive layer is placed upon a metal matrix and has then exposed on it the grid of the desired holes for the shear foil, the exposed portions of the sensitive layer subsequently being treated so that they will form the holes. The non-exposed portions of the light-sensitive layer are then removed, and the metallically blank portions of the matrix are treated so that a subsequent adherence of deposited metal to them is avoided. Subsequent metal deposition may be in form of nickel which deposits in a galvanoplastic bath on the metallically blank portions of the matrix but not on the exposed portions of the light-sensitive layer. Due to distortions of the electric field the galvanoplastically applied nickel does not smoothly fill the gaps in the layer, but instead deposits more material at the marginal zones than in the inner zones, so that a series of "metal islands" develop which have approximately a mushroom-cap shaped configuration. These metal islands are also treated so that further nickel deposition on them can be released again, rather than becoming firmly united with them. The then further deposited metal layer follows smoothly these metal islands, that is a further non-uniform deposition of the material no longer takes place. A double foil, composed of the thinner underlayer and the thicker overlayer can now be removed from the matrix and can readily be split with low mechanical force into two single foils of which the thicker is the actual shear foil whereas the thinner is re-used for scrap purposes, i.e. it is melted down for subsequent reuse.

Other ways of producing the shear foil of the invention in galvanoplastic manner are also known in the art. In all instances where the shear foil is produced galvanoplastically it must be kept in mind that due to the distortion of the electric field in marginal zones there is a certain relationship between the obtainable thickness growth of a layer and the hole and unperforated material size. If for example the width of the holes in FIG. 4 is approximately 0.58 millimeters and the width of the unperforated material between them is 0.23 millimeters, then the obtainable growth is on the order of 0.015 millimeters. On the other hand, a growth of 0.007 millimeters is obtained if the width of the holes is chosen to be 0.27 millimeters and the width of the unperforated portions between them is chosen to be 0.14 millimeters. When producing a mask through which the light-sensitive layer is to be exposed in order to form a grid corresponding to the subsequently produced holes, these circumstances must of course be taken into account.

Evidently, other ways of producing the shear foil of the invention can also be chosen. For example, laser light may be employed which can be used to directly burn the holes into a metal foil. Using digital light deflectors, which for example may operate according to the principle of ultrasound deflection, it is possible to use a single laser to burn large numbers of holes through a metal foil. However, according to the present state of the art, it is not yet possible to form holes having raised borders with the aid of lasers.

It will be understood that each of the elements described above, or two or more together, may also find a useful application in other types of constructions differing from the types described above.

While the invention has been illustrated and described as embodied in a shear foil for a dry shaver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A shear foil for a dry shaver, comprising a flexible sheet material body having a central portion provided with holes of a diameter between substantially 0.3 and 0.7 mm for passage of beard stubble therethrough, and perforate peripheral shear-foil mounting portions being lateral edges and provided from the central portion up to said edges with a continuous field of holes of a diameter smaller than at least some of those in said central portion but not less than substantially 0.02 mm, the holes in the respective portions being separated by sheet material strips and the bending resistance of said sheet-material body being substantially uniform throughout.

2. A shear foil as defined in claim 1, wherein the ratio of the width of said strips to the diameter of said holes in said peripheral portions is about 3 : 1 so that said shear foil has a substantially uniform bending resistance throughout its length and width.

3. A shear foil as defined in claim 1, wherein the ratio of width of said strips to the diameter of said holes in said central portion is constant and the ratio of width of said strips to the diameter of said holes in said peripheral portion is also constant.

4. A shear foil as defined in claim 1, wherein said central portion has transitional regions which merge into said peripheral portions and in which said holes of said central portion have a diameter which is the smaller the closer they are to said peripheral portions.

5. A shear foil as defined in claim 1, wherein said central portion has transitional regions which merge with said peripheral portions and in which the center-to-center spacing of said holes of said central portion is the larger the closer such holes are to said peripheral portion.

6. A shear foil as defined in claim 1, wherein said central portion has transitional regions which merge into said peripheral portions and in which said holes of said central portion have a uniform diameter but the center-to-center spacing between adjacent holes is greater than in the remainder of said central portion.

7. A shear foil as defined in claim 1, wherein said central portion has transitional regions which merge into said peripheral portions and in which said holes of said central portion have a uniform diameter but the center-to-center spacing between adjacent holes is smaller than in the remainder of said central portion.

8. A shear foil as defined in claim 1, wherein said central portion has transitional regions which merge into said peripheral portions and in which said holes of said central portion have a uniform center-to-center spacing but their diameter decreases in direction towards the respective peripheral portion, the holes in said peripheral portion having the same diameter as the holes which are located in said transitional regions immediately adjacent the respective peripheral portions.

9. A shear foil as defined in claim 1, wherein said central portion has transitional regions which merge with said peripheral portions and in which said holes of said central portion have a uniform center-to-center spacing but their diameter decreases in direction towards the respective peripheral portion, and wherein the holes of said peripheral portions also have uniform center-to-center spacing and their diameter decreases in direction outwardly, away from the respective transitional region.

10. A shear foil as defined in claim 1, said sheet material body being a peripheral margin and being provided with cut-outs other than said holes; and further comprising metallic reinforcing layers on said peripheral margin and on portions of said sheet material body which bound said cut-outs.

11. A shear foil as defined in claim 10, wherein the dimensions of said reinforcing layers correspond to the dimensions of said sheet material strips of the portion whereon said layers are provided.

* * * * *